United States Patent [19]

Lumaret et al.

[11] Patent Number: 4,512,915

[45] Date of Patent: Apr. 23, 1985

[54] COMPOSITION AND METHOD OF INHIBITING CORROSION BY WATER OF METAL SUBSTRATES

[75] Inventors: Jean-Claude Lumaret, Bethune; Serge Gosset, Lestrem; Michel Huchette, Merville, all of France

[73] Assignee: Roquette Freres, Lestrem, France

[21] Appl. No.: 410,987

[22] Filed: Aug. 24, 1982

[30] Foreign Application Priority Data

Aug. 31, 1981 [FR] France ..... 81 16601

[51] Int. Cl.[3] ..... C23F 11/18

[52] U.S. Cl. ..... 252/389 A; 252/181; 252/389 R; 422/17; 422/18; 210/765

[58] Field of Search ..... 252/389.2, 389.52, 396, 252/181; 422/17, 18, 19; 106/14.12, 14.13; 210/749, 765

[56] References Cited

U.S. PATENT DOCUMENTS

| | | | |
|---|---|---|---|
| 2,529,178 | 11/1950 | Nieland et al. | 422/17 |
| 3,116,105 | 12/1963 | Kerst | 422/18 X |
| 3,711,246 | 1/1973 | Foroulis | 252/389.2 |
| 4,108,790 | 8/1978 | Foroulis | 106/14.12 X |

FOREIGN PATENT DOCUMENTS

| | | |
|---|---|---|
| 927841 | 6/1963 | United Kingdom . |
| 1434804 | 5/1976 | United Kingdom . |
| 1459390 | 12/1976 | United Kingdom . |

OTHER PUBLICATIONS

Werkstoffe und Korrosion, vol. 28, No. 7, Jul. 1977, Ref. 77-0923, p. 506.

*Primary Examiner*—Ben R. Padgett
*Assistant Examiner*—Matthew A. Thexton
*Attorney, Agent, or Firm*—Larson and Taylor

[57] ABSTRACT

A composition for inhibiting corrosion by water of metal substrates comprises zinc gluconate or glucoheptonate and at least one water-soluble inorganic polyphosphate.

19 Claims, No Drawings

COMPOSITION AND METHOD OF INHIBITING CORROSION BY WATER OF METAL SUBSTRATES

The invention relates to a composition for inhibiting corrosion of metal substrates by water; it relates also to a method of inhibiting corrosion of these same metal substrates by water, this method applying said composition or its constituents. The metal substrates concerned are in particular those based on iron, copper, nickel, aluminum and the like, and alloys of these metals, in particular steels and brasses.

The corrosion of the abovesaid metal substrates by water occurs through oxidation of said substrates when they are in contact with water; this contacting takes place particularly in water storage installation, or in cooling installations where water is used as the energy transfer fluid.

It is particularly in these installations that the invention provides inhibition of corrosion by water.

Two types of cooling installations are to be distinguished, namely:

open circuit cooling installations, closed circuit cooling installations.

In installations of the first type (open circuit), water is taken from a source such as a river, the sea, or a lake, and traverses the cooling circuit once only and is then evacuated.

In installations of the second type (closed circuit), the water is recirculated; these recirculating closed circuits generally comprise a cooling tower or the like in which the heated water is cooled by contact with the atmospheric air.

The corrosion problems are generally minimal in open circuit cooling installations; this is not the same in those with a closed circuit. During the contact between the air and the water, a considerable amount of air is dissolved in the cooling water and is thus drawn into the cooling installation. The oxygen of the air dissolved in the water diffuses up to the interface of the water and of the constituent metal substrate of the cooling installation and corrodes the heat exchangers, the pipes and the containers of metal included in the latter.

This corrosion is still more marked when sea water is used instead of fresh water as the heat transfer fluid.

These corrosion phenomena are each year the cause of considerable losses of metal and large sums are constantly invested in research seeking to try to prevent or at least reduce this corrosion.

It has already been proposed to reduce the corrosion by the addition to the water brought into contact with the metal substrate of inorganic substances such as polyphosphates, chromates and mixtures of the two.

Now the use of these salts presents serious drawbacks.

The polyphosphates are reconverted under the action of moderate heat into orthophosphates which can react with the "water hardness" salts to encourage the formation of mud or sludge or of tartar. A very distinct reduction in the efficiency of the heat transmission results therefrom and possibly an acceleration of the corrosion.

In addition, the presence of the polyphosphates gives rise to the well-known phenomenon of eutrophization of water.

The chromates, which are very effective corrosion inhibitors, have the drawback of being very toxic; water containing chromates cannot be evacuated into rivers or the sea, without having undergone a prior purification treatment, often expensive.

Moreover, it has been observed that, in certain circumstances, chromates can accelerate corrosion, particularly by the so-called phenomenon of "pitting" when they are present in low concentrations. This corrosion by pitting may be very severe and may result in perforation of the metal substrate, particularly of pipes constituting a cooling installation.

The use has also been proposed, for corrosion inhibitors, of alkali or alkaline-earth metal gluconates as well as ammonium gluconate, sodium gluconate being the salt mostly adopted, apparently by reason of its ease of availability and its excellent solubility in water. The inhibiting power of sodium gluconate used alone having nonetheless been judged insufficient, it has often been proposed in combination with so-called "synergistic agents", selected from among organic acids, aromatic acids, silicates, phosphates, tannins, acids and zinc sulfate.

Other salts of gluconic acid, namely those of manganese, of cobalt, cadmium and zinc have also been applied alone. Among these salts, that of zinc has been retained as being a good inhibitor to reduce the corrosion of soft steel in stagnant sea water.

None of the solutions proposed has however given entire satisfaction and the Applicants applied themselves to the objective of perfecting means, that is to say a composition and a method which respond better to the various desiderata of practice than hitherto in the field of combatting the corrosion of metal substrates by water.

Now, whilst observing in the course of numerous tests that were carried out to compare the behavior of these various known inhibiting compositions that neither the system "sodium gluconate—polyphosphate—zinc sulfate", nor the system "zinc gluconate alone" enabled complete inhibition of corrosion to be achieved and, quite to the contrary, lead in certain cases, after temporary inhibition of the corrosion, to an acceleration of the latter due to the fact of the appearance of pitting on the surface of the metals, Applicants have had the merit of finding that, surprisingly and unexpectedly, the corrosion of metal substrates by water could be inhibited with an effectiveness unknown until then by resorting to a composition comprising zinc gluconate or glucoheptonate and one or several inorganic polyphosphates, soluble in water.

Consequently, the composition for inhibiting water corrosion of metal substrates according to the invention comprises zinc gluconate or glucoheptonate and at least one inorganic polyphosphate soluble in water.

The method of inhibiting the corrosion of said metal substrates by water, according to the present invention, comprises the addition to the water, whose corrosive power must be inhibited, of the abovesaid composition or of its constituents.

The composition and the method according to the invention are applied advantageously to protection against corrosion:

on the one hand, by fresh water, of heat exchangers in chemical and petroleum industries as well as in air concitioning devices (individual dwellings, factories, playhouses, theaters, and the like) and, on the other hand, and particularly by sea water, of cooling installations using this type of water.

It is well known, that the corrosion exerted by sea water is very difficult to inhibit, by reason essentially of the eminently corrosive nature of this water and of the complexity of the factors which determine it, with the result that high inhibitor concentrations were generally necessary in order to obtain an inhibition which remained however only partial.

A determining advantage procured by the invention resides in the fact of permitting complete inhibition of the corrosion in sea water by means of amounts of inhibititing composition which are small in comparison with the amounts of inhibiting substances that it was necessary to use in the prior art to arrive at an only partial result; this advantage is due to the unexpected synergy and which Applicants have had the merit of establishing, existing between the zinc gluconate or glucoheptonate and the inorganic polyphosphates soluble in the water.

To constitute the composition in accordance with the invention, it is preferred to resort to ammonium and alkali metal polyphosphates and, more particularly to ammonium or alkali metal hexametaphosphates and tripolyphosphates. The sodium hexametaphosphate is the preferred salt.

To constitute the abovesaid composition, the ratio by weight between the zinc gluconate or the zinc glucoheptonate and the polyphosphate are selected within the limits of 1/10 to 15/1, preferably from 1/7 to 7/1 and, more preferably still, from 1/5 to 5/1.

An inhibiting composition according to the invention which is particularly preferred comprises zinc gluconate and sodium hexametaphosphate in the ratio zinc gluconate/hexametaphosphate ranging from 1/7 to 7/1, preferably from 1/5 to 5/1 and, still more preferably, from $\frac{1}{4}$ to 4/1; the synergy is more pronounced for the ratios of zinc gluconate/hexametaphosphate situated within the more preferred limits.

The inhibiting composition according to the invention can be in the form of a mixture in the solid state comprising the two above-mentioned constituents, or again in the form of an aqueous solution of said constituents.

According to the method of inhibiting corrosion according to the invention, the abovesaid composition or its constituents are added to the water whose corrosion effects must be inhibited.

The composition or its constituents are added in such an amount that the concentration of the water in the inhibiting composition is about 10 to about 2000 ppm, preferably from 15 to 1500 ppm and, more preferably, from 20 to 1000 ppm.

When the composition according to the invention is based on zinc gluconate and sodium hexametaphosphate, this composition is added to the water whose corrosion properties must be inhibited, preferably in an amount such that the concentration in this water of this composition is:

- from 10 to 750 ppm, preferably from 15 to 600 ppm, where fresh water is concerned, and
- from 20 to 1000 ppm, preferably from 80 to 700 ppm where sea water is concerned.

The best results are obtained when the abovesaid concentration is higher than 400 and less than 700 ppm.

Applicants who do not wish to be restricted to this theory, consider that the inhibition of the corrosion is produced due to the formation of a protective film on the surface of the metal substrate, which film prevents the diffusion of the dissolved oxygen to the surface of the metal.

In addition to its high effectiveness in the inhibition of the corrosion of the metal substrates by fresh water and by sea water, the composition according to the invention has the very great advantage of not causing corrosion by pitting when it is present in low concentration, or when this concentration becomes low consequent, for example, on exhaustion in the water of said composition.

It may in addition be applied advantageously in the following cases:

- as an additive to machining fluids particularly to cutting oils used in metal shaping industries; it then plays a protective role for the metal parts,
- as an additive to certain protective coatings, particularly to those which are in the form of a film obtained from aqueous solutions of cellulosic derivatives, of polyvinylic alcohols or of starch derivatives. Here again it reinforces the protection of the metal parts comprising the coating.

The invention will, in any case, be well understood by means of the non-limiting examples which follow and which relate to preferred embodiments.

EXAMPLE 1

Composition comprising a mixture of zinc gluconate and sodium hexametaphosphate This composition is applied to inhibit the oxidizing corrosion of steel by sea water saturated with dissolved oxygen.

The experimental method used consists of measuring and comparing the losses of metal recorded for identical metal specimens of which one plays the role of control specimen and is placed in sea water saturated with dissolved oxygen, the other playing the role of test specimen placed in the same water with which has been included the composition according to the invention.

These metal specimens are of steel of type E 24-1 (0.22% carbon—0.075% phosphorus—0.062% sulfur), weighing 45 to 50 g approximately and having sizes of approximately 6.5 cm×9.5 cm. The water used for the tests is a "synthetic" sea water of the composition indicated below:

| | |
|---|---|
| NaCl | 25.6 g/l |
| MgCl | 2.4 g/l |
| $MgSO_4$ | 2.3 g/l |
| KCl | 0.73 g/l |
| $NaHCO_3$ | 0.2 g/l |
| NaBr | 0.28 g/l |
| $CaCl_2$ | 1.1 g/l |
| distilled water in sufficient amount for one liter. | |

Into this water, with stirring, air is bubbled constantly, which has the effect of maintaining the concentration of dissolved oxygen at saturation.

This sea water used alone is a control solution in which the control specimen is placed. The test solution in which the test specimen is placed comprises the same sea water saturated with oxygen by bubbling air therethrough in which a given amount of the abovesaid inhibiting composition has been dissolved. The temperature of the control and test solutions is kept at about 60° C.

Before the experiment, the steel specimens were polished, chemically degreased, scoured in a hydrochloric acid solution and washed several times in distilled water; they were then dried and weighed.

The length of the test was from 800 to 1000 hours. During this test at intervals of at least 24 hours, the amount of metal removed by corrosion was determined by weighing. By "degree or rate of corrosion" was designated that amount of metal, expressed in milligrams per square decimeter, removed at the time of each weighing.

The efficiency "E" of a given inhibiting composition, expressed in %, is given by the formula:

$$E = \frac{I_o - I}{I_o} \times 100$$

in which $I_o$ is the degree of corrosion recorded for sea water alone and I the degree of corrosion recorded for sea water in the presence of the inhibiting composition.

The meaning of the abreviations and formulae appearing in the examples and tables below is as follows:

$Gl_2Zn$: zinc gluconate
HMPP: sodium hexametaphosphate
E: efficiency in %
I: degree of corrosion in mg/dm$^2$ of of the test solution
$I_o$: degree of corrosion in mg/dm$^2$ of the control solution
GlNa: sodium gluconate
GDL: gluconodeltalactone
$Na_{2/}SiO_3$: sodium silicate
$ZnSO_4$: zinc sulfate
ZnO: zinc oxide
TPP: sodium tripolyphosphate
PP: sodium pyrophosphate
$GH_2Zn$: zinc glucoheptonate.

Unless otherwise indicated, the zinc gluconate used in the tests was a zinc gluconate trihydrate; the concentration of zinc gluconate was however always expressed without taking into account the three molecules of water of crystallization.

The tests, whose results are collected in Table I, and which have been carried out at a temperature of 60° C., comprise besides the control test, comparison tests with known inhibiting agents and tests with inhibiting compositions according to the invention; in all these tests, the total concentration of inhibiting agent according to the invention was 600 ppm.

Said tests carried out within the scope of this first example comprise:

- examination as comparative inhibiting agent of $ZnGl_2$ alone at a concentration of 600 ppm,
- examination of the action of a composition according to the invention constituted by equal parts by weight of $ZnGl_2$ and HMPP (concentration of 300 ppm of each constituent),
- examination as comparative inhibiting agent of a composition of the prior art based on NaGl and $ZnSO_4$ and of which the constituents were introduced into the sea water in an amount such that the concentration in this sea water was 440 ppm of NaGl and 160 ppm of $ZnSO_4$,
- examination as comparative inhibiting agent of HMPP alone at a concentration of 600 ppm,
- examination of the action of a composition according to the invention of which the constituents were present in respective amounts such that the concentration of $ZnGl_2$ was 450 ppm and that of HMPP 150 ppm,
- examination of the action of a composition according to the invention whose constituents were present in respective amounts such that the concentration of $ZnGl_2$ was 150 ppm and that of HMPP 450 ppm.

TABLE I

| | | Test Solutions | | | | | | | | | | | |
|---|---|---|---|---|---|---|---|---|---|---|---|---|---|
| | Control solution | $Gl_2Zn$ 600 ppm | | $Gl_2Zn$ 300 ppm HMPP 300 ppm | | GlNa 440 ppm $ZnSO_4$ 160 ppm | | HMPP 600 ppm | | $Gl_2Zn$ 450 ppm HMPP 150 ppm | | $Gl_2Zn$ 150 ppm HMPP 450 ppm | |
| T in hours | I. in mg/dm$^2$ | I in mg/dm$^2$ | E in % | I in mg/dm$^2$ | E in % | I in mg/dm$^2$ | E in % | I in mg/dm$^2$ | E in % | I in mg/dm$^2$ | E in % | I in mg/dm$^2$ | E in % |
| 24 | 159 | 65 | 59,1 | 0 | 100 | 0 | 100 | 0 | 100 | 0 | 100 | | |
| 48 | 316 | | | 0 | 100 | 27,6 | 91,6 | 0 | 100 | 0 | 100 | | |
| 72 | 457,2 | | | 0 | 100 | 71 | 84,5 | 0 | 100 | 0 | 100 | | |
| 96 | | 350 | 42,1 | 0 | 100 | | | 0 | 100 | 6,5 | 98,9 | 35,5 | 94,1 |
| 144 | 861,8 | | | | | 355 | 58,8 | 0 | 100 | | | | |
| 168 | 999,4 | 783 | 26,0 | 52,5 | 95,0 | 614,8 | 38,5 | 18,2 | 98,2 | 26,5 | 97,5 | 89,0 | 91,6 |
| 192 | 1 154,4 | | | | | 954,1 | 17,3 | 23,5 | 98 | | | | |
| 216 | 1 305,3 | | | | | 1347,4 | favors corrosion | 32,0 | 97,6 | | | | |
| 240 | 1 447 | | | | | | | | | | | | |
| 264 | | 1 600 | favors corrosion | 61,5 | 96,3 | | | | | 25,0 | 98,5 | 99,0 | 94,0 |
| 312 | 1 936,6 | | | | | | | | | | | | |
| 336 | 2 138,7 | 2 711 | | 158,0 | 92,5 | | | 25,1 | 98,8 | 38,0 | 98,2 | 129,5 | 93,9 |
| 360 | | | | | | | | | | | | | |
| 384 | | | | | | | | | | | | | |
| 408 | 2 633,5 | | | | | | | 57,5 | 97,8 | | | | |
| 432 | | 5 746,5 | | 281,0 | 89,7 | | | | | 49,4 | 98,2 | 430,0 | 84,2 |
| 480 | 2 861,5 | | | | | | | | | | | | |
| 504 | 3 229,7 | | | | | | | 72,0 | 97,8 | | | | |
| 528 | 3 421 | | | | | | | 185,0 | 94,6 | | | | |
| 576 | 3 766,8 | | | | | | | | | | | | |
| 600 | | | | 387,8 | 89,7 | | | | | 64,8 | 98,3 | 748,2 | 80,2 |
| 624 | | | | | | | | | | | | | |
| 648 | 4 134,2 | | | | | | | | | | | | |
| 672 | 4 278 | | | 452,6 | 89,3 | | | 365,2 | 91,5 | 89,9 | 97,9 | 995,1 | 76,5 |
| 696 | 4 459,4 | | | | | | | 449,1 | 90,0 | | | | |
| 720 | 4 617,6 | | | | | | | 530,0 | 88,5 | | | | |
| 744 | 4 754,9 | | | | | | | | | | | | |
| 768 | 4 838,4 | | | 510,1 | 89,5 | | | 650,0 | 86,6 | 118,2 | 97,6 | 1218,6 | 74,8 |
| 816 | 5 002,4 | | | | | | | | | | | | |

TABLE I-continued

| | | Test Solutions | | | | | | | | | | | |
|---|---|---|---|---|---|---|---|---|---|---|---|---|---|
| | Control solution | $Gl_2Zn$ 600 ppm | | $Gl_2Zn$ 300 ppm HMPP 300 ppm | | GlNa 440 ppm $ZnSO_4$ 160 ppm | | HMPP 600 ppm | | $Gl_2Zn$ 450 ppm HMPP 150 ppm | | $Gl_2Zn$ 150 ppm HMPP 450 ppm | |
| T in hours | I. in mg/dm² | I in mg/dm² | E in % | I in mg/dm² | E in % | I in mg/dm² | E in % | I in mg/dm² | E in % | I in mg/dm² | E in % | I in mg/dm² | E in % |
| 840 | | | | 559,5 | 89,4 | | | | | 162,8 | 96,9 | 1400,8 | 73,5 |
| 936 | 5 896,8 | | | 660,7 | 88,8 | | | 1320,0 | 77,6 | 235,6 | 96,0 | 1695,5 | 71,2 |

T = Time elapsed on each weighing from the start of the experiment.

It is emphasized that the total duration of the test was very long, by reason of the very high effectiveness of the inhibiting compositions according to the invention.

Before each weighing, each specimen was rinsed with the test solution, which results each time in the destruction of what Applicant assumes to be an inhibiting film; it follows that the test conditions were more severe than reality, which appears all the more clearly on examining the results collected in Table I. In fact, it is observed that, when the time elapsing between two successive weighings is increased, the efficiency of all the solutions tested has a tendency to increase slightly whereas the efficiency drops when the time elapsing between two successive weighings diminishes.

The results obtained and collected in Table I show that, if the hexametaphosphate alone shows proof of excellent corrosion inhibiting power, during the first 700 hours, its effectiveness however diminishes afterwards. This is due to the fact that the sodium hexametaphosphate hydrolyses rapidly into insoluble orthophosphates which give rise to the formation of considerable amounts of sludge or of tartar which are deposited on the specimens and which thus protect the metallic substrates.

In addition, besides the metal substrates it is the whole of the installations which is rapidly entartrated and this almost irreversibly; this envolves an immediate considerable reduction in the heat exchanges in the cooling installations using HMPP alone.

On the contrary, the composition inhibiting corrosion according to the invention enables the aforesaid drawbacks to be eliminated, whilst being more effective, especially when the durations of immersion are greater than 600 hours.

It appears, in addition, on examining the results of comparative tests collected in Table I, that the inhibiting agent of the prior art constituted by sodium gluconate and zinc sulfate, as well as zinc gluconate applied alone are not capable of inhibiting the corrosion of metals in sea water. After 192 hours, the effectiveness is zero and there is then even witnessed a loss of the test sample greater than that of the control sample.

It is observed finally that the best results, under these conditions, are recorded when the ratio between the zinc gluconate and the sodium hexametaphosphate (composition according to the invention) is in the vicinity of 3/1.

It is interesting to note that the loss in weight of the control specimen is directly proportional to the time of immersion in the control solution and may be represented by the equation line:

$$y = 6.3x$$

in which:

x represents the time in hours and y represents the loss in mg/dm².

EXAMPLE 2

Comparative test showing the superiority of the performances obtained with an inhibiting composition according to the invention based on zinc gluconate and sodium hexametaphosphate with respect to that obtained with a composition of the prior art based on sodium hexametaphosphate, sodium gluconate and zinc sulfate, that is to say introducing the constituent ions of zinc gluconate.

The same "synthetic" sea water stirred and saturated with dissolved oxygen was used as in Example 1; the temperature of the baths was again 60° C. The experimental procedure of Example 1 was used.

The concentration of the corrosion sea water in the composition according to the invention was 600 ppm in the proportion of:

300 ppm of $ZnGl_2$ and 300 ppm of HMPP.

The concentration of the composition according to the prior art in this sea water used in the comparative test is such that said composition:

is 300 ppm of HMPP and introduces a concentration of gluconate anion and of zinc cation identical with that of the composition according to the invention, which, in other words, gives:

$$300 \text{ ppm of } ZnGl_2 \begin{cases} \rightarrow 260 \text{ ppm } Gl^- \rightarrow 290 \text{ ppm of NaGl} \\ \rightarrow 43 \text{ ppm } Zn^{++} \rightarrow 110 \text{ ppm of } ZnSO_4. \end{cases}$$

The measurement of the losses of metal undergone by the specimens in the course of the progress of the test were carried out, as in Example 1, generally 24 hours by 24 hours.

The results obtained are collected in Table II.

TABLE II

| | CONTROL ("synthetic" sea water) | Composition according to the invention | | Prior art composition | |
|---|---|---|---|---|---|
| T in hours | I. in mg/dm² | I in mg/dm² | E in % | I in mg/dm² | E in % |
| 24 | 159 | 0 | 100 | 0 | 100 |
| 48 | 316 | 0 | 100 | 0 | 100 |
| 72 | 457,2 | 0 | 100 | 0 | 100 |
| 144 | 861,8 | | | | |
| 168 | 999,4 | 52,5 | 95 | 44,1 | 95,6 |
| 192 | 1 254,4 | | | | |
| 216 | 1 305,3 | | | | |
| 240 | 1 447 | | | | |
| 264 | | 61,5 | 96,3 | | |
| 312 | 1 936,6 | | | | |
| 336 | 2 138,7 | 158 | 92,5 | 292,3 | 86,3 |
| 408 | 2 633,5 | | | 430,4 | 83,7 |
| 432 | | 281 | 89,7 | | |
| 480 | 2 861,5 | | | | |

TABLE II-continued

| T in hours | CONTROL ("synthetic" sea water) I. in mg/dm² | Composition according to the invention I in mg/dm² | Composition according to the invention E in % | Prior art composition I in mg/dm² | Prior art composition E in % |
|---|---|---|---|---|---|
| 504 | 3 229,7 | | | 664,4 | 79,4 |
| 528 | 3 421 | | | | |
| 576 | 3 766,8 | | | | |
| 600 | | 387,8 | 89,7 | | |
| 648 | 4 134,2 | | | | |
| 672 | 4 278,0 | 452,6 | 89,3 | 1 242,5 | 71,0 |
| 696 | 4 459,4 | | | | |
| 720 | 4 617,6 | | | | |
| 744 | 4 754,9 | | | | |
| 768 | 4 838,4 | 510,1 | 89,5 | | |
| 816 | 5 002,4 | | | | |
| 936 | 5 896,8 | 660,7 | 88,8 | 1 785 | 69,7 |

T = Time elapsed on each weighing since the start of the experiment.

On examining the results collected in Table II, it is observed that those obtained with "sodium gluconate+zinc sulfate+sodium hexametaphosphate" are very much inferior to those obtained with the inhibiting composition according to the invention.

These results show clearly that it is indeed the presence of the zinc gluconate as such which is effective, the same performances not being obtainable in ensuring simply the simultaneous presence of the glyconate ion and the zinc ion.

Thus, after 336 hours, it is observed that E passes from a reduction of 7.8% (composition according to the invention) to a reduction of 13.7% (prior art composition).

In the same way, after 936 hours, E passes from a reduction of 11.2% (composition according to the invention) to a reduction of 30.3%, the loss of iron of the specimens passing from 660.7 to 1785 mg/dm².

EXAMPLE 3

The results obtained with the following inhibiting compositions were compared:

Composition A (according to the invention)
- 50% of zinc gluconate
- 50% of HMPP Composition B (according to the prior art)
- 50% of zinc gluconate
- 50% of $Na_2SiO_3$.

The test conditions were the same as in Examples 1 and 2, apart from the fact that the concentration in the test solution of inhibiting compostion was each time 530 ppm in total.

The measurements of the metal losses were again done by weighings at 24 hour intervals or longer.

The results obtained are collected in Table III.

TABLE III

| T in hours | Control solution I. in mg/dm² | Test solution containing 530 ppm of inhibiting composition: Composition A HMPP 50% $Gl_2Zn$ 50% I in mg/dm² | Composition A E in % | Composition B $Na_2SiO_3$ 50% $Gl_2Zn$ 50% I in mg/dm² | Composition B E in % |
|---|---|---|---|---|---|
| 24 | 159 | 0 | 100 | | |
| 48 | 316 | 0 | 100 | | |
| 72 | 457,2 | 0 | 100 | | |
| 144 | 861,8 | 0 | 100 | | |
| 168 | 999,4 | 0 | 100 | 188,7 | 82,2 |
| 192 | 1 154,4 | 0 | 100 | | |
| 216 | 1 305,3 | 0 | 100 | | |
| 240 | 1 447 | 0 | 100 | 415,4 | 72,5 |
| 312 | 1 936,6 | 8,9 | 99,5 | | |
| 336 | 2 138,7 | 14,2 | 99,3 | 629,2 | 70,3 |
| 408 | 2 633,5 | 18,6 | 99,3 | 770,0 | 70,0 |
| 480 | 2 861,5 | 34,8 | 98,8 | | |
| 504 | 3 229,7 | 42,9 | 98,7 | 903,6 | 71,5 |
| 528 | 3 421 | 58,3 | 98,3 | | |
| 576 | 3 766,8 | 79 | 97,9 | | |
| 648 | 4 134,2 | 73,3 | 98,2 | | |
| 672 | 4 278 | 80,2 | 98,1 | | |
| 696 | 4 459,4 | 108,1 | 97,6 | | |
| 720 | 4 617,6 | 120 | 97,4 | | |
| 744 | 4 754,4 | 128,8 | 97,3 | | |
| 816 | 5 002,4 | 160 | 96,8 | | |

T = Time elapsed on each weighing since the start of the experiment.

On examining these results, it is observed that, for example, at the time of the weighing carried out after 672 hours, the loss of metal in the test with the composition A according to the invention was 80.2 mg/dm² whereas it was so considerable with the composition B that the result has not even been recorded.

It is hence clearly established that the inhibiting qualities of the composition B are very much inferior to those of composition A.

EXAMPLE 4

Study of the performance of a composition according to the invention containing 50% of zinc gluconate and 50% of HMPP with respect to its concentration in the test solution.

The experimental conditions were those of Examples 1, 2 and 3. The duration of the tests was of about 1000 hours.

The concentrations studied correspond respectively to 400, 450, 500, 530, 565 and 600 ppm.

The results obtained are collected in Table IV.

TABLE IV

| T in hours | $Gl_2Zn$ 50% HMPP 50% Concentration 400 ppm I in mg/dm² | $Gl_2Zn$ 50% HMPP 50% Concentration 400 ppm E in % | $Gl_2Zn$ 50% HMPP 50% Concentration 150 ppm I in mg/dm² | $Gl_2Zn$ 50% HMPP 50% Concentration 150 ppm E in % |
|---|---|---|---|---|
| 96 | | 100 | | 100 |
| 168 | | 100 | 2,43 | 99,76 |
| 264 | | 100 | 8,10 | 99,51 |
| 336 | 36,47 | 98,29 | 17,81 | 99,17 |
| 432 | 116,60 | 95,72 | 22,67 | 99,17 |
| 504 | 519,03 | 83,93 | 27,53 | 99,15 |
| 600 | 943,32 | 75,04 | 37,25 | 99,01 |
| 672 | 1194,33 | 72,08 | 43,72 | 98,98 |
| 768 | 1407,29 | 70,91 | 63,16 | 98,69 |
| 840 | | | 63,16 | 98,81 |
| 936 | | | 66,40 | 98,87 |
| 1032 | | | 76,11 | 98,83 |
| 1104 | | | 44,53 | 98,36 |

TABLE IV-continued

| T in hours | $Gl_2Zn$ 50% HMPP 50% Conc. - 550 ppm I in mg/dm² | E in % | $Gl_2Zn$ 50% HMPP 50% Conc. - 530 ppm I in mg/dm² | E in % | $Gl_2Zn$ 50% HMPP 50% Conc. - 565 ppm I in mg/dm² | E in % | $Gl_2Zn$ 50% HMPP 50% Conc. - 600 ppm I in mg/dm² | E in % |
|---|---|---|---|---|---|---|---|---|
| 24 | 0,7 | 99,5 | | 100 | 1,1 | 99,3 | | 100 |
| 48 | 3 | 99 | | 100 | | 3 | 99 | 100 |
| 72 | 6,8 | 98,5 | | 100 | 6,8 | 98,5 | | 100 |
| 96 | 17 | 97,2 | | 100 | 12,0 | 98 | | 100 |
| 168 | 30 | 97,2 | | 100 | 22,5 | 97,9 | 52,5 | 95 |
| 264 | 35 | 97,9 | | 100 | 26,0 | 98,4 | 61,5 | 96,3 |
| 336 | 49,5 | 97,7 | 14,2 | 99,3 | 51,0 | 97,6 | 158,0 | 92,5 |
| 432 | 60,7 | 97,8 | 40,8 | 98,5 | 85,0 | 96,9 | 281 | 89,7 |
| 504 | 63,0 | 98,9 | 47,3 | 98,5 | 94,5 | 97,0 | 324,5 | 89,7 |
| 600 | 64,8 | 98,3 | | | 110,9 | 97,1 | 387,8 | 89,7 |
| 672 | 72,1 | 98,3 | 80,2 | 98,1 | 138,5 | 96,7 | 452,6 | 89,3 |
| 768 | 72,1 | 98,5 | 744h-128,8 | 97,3 | 181,4 | 93,3 | 510,1 | 89,5 |
| 840 | 86,6 | 98,4 | | | 216,2 | 95,9 | 559,5 | 89,4 |
| 936 | 96,4 | 98,4 | 816h-160 | 96,8 | 251,8 | 95,7 | 660,7 | 88,8 |

These results show that under these conditions the efficiency is good for all concentrations of the inhibiting composition examined and that they show a maximum towards about 450 to 500 ppm.

For this concentration there is an efficiency of 98.8% after 936 hours of testing.

Comparison with Example 1 shows that this effectiveness is greater than that which had been recorded for a concentration of inhibiting composition of 600 ppm, the ratio of the zinc gluconate to the HMPP being 3/1.

EXAMPLE 5

The performance obtained with a composition according to the invention comprising 50% of zinc gluconate and 50% of HMPP and applied at different concentrations, on the one hand, in fresh water and, on the other hand, in sea water was studied.

The same steel test pieces were used as in Example 1 and the corrosion medium (synthetic sea water according to Example 1 or fresh water) was thermostated to 20° C.

To illustrate the performances achieved, the phenomenon which will now be described was resorted to.

When it is placed in contact with the abovesaid corrosion media, the metal substrate is the site of cathodic reduction and anodic dissolution reactions respectively representable as follows:

$$nM^{+} + ne^{-} \rightarrow \frac{n}{2} H_2$$

$$M_n \rightarrow H^{n+} + ne^{-}.$$

Following these reactions, the metal takes up a stable potential called "corrosion potential" and denoted by "Pot cor" for which no apparent current passes through the metal-solution interface.

If the potential of the metal is varied, an electric current i results therefrom. To the variation i=f (Pot) corresponds a so-called polarization curve whose shape is characteristic of the metal/solution system envisaged.

The metal-solution interface is generally compared to an equivalent circuit identified by RC and composed of a resistance Rp (polarization resistance) and a capacity C in parallel. Rp can be measured by the slope d Pot/di at the potential "Pot cor".

The apparatus used for the measurement of Rp is that marketed by the Tacussel Company under the name "CORROVIT". This apparatus is coupled to a plotting table of the XY TRP 10–100 type marketed by the Sefram Company.

The results of the measurements of Rp are expressed in ohms (Ω).

They are collected in Table V, the corrosion medium being synthetic sea water, and in Table VI, the corrosion medium being fresh water.

(a) Synthetic sea water

The abovesaid composition was applied at the successive concentrations of 50, 100, 260 and 530 ppm.

TABLE V

| Concentration of inhibiting composition in the corrosion medium | 50 ppm | 100 ppm | 260 ppm | 530 ppm |
|---|---|---|---|---|
| Rp (in Ω) | $2.3 \times 10^3$ | $4.1 \times 10^3$ | $6.3 \times 10^3$ | $8.4 \times 10^3$ |

It appears on examining Table V that in a synthetic sea water medium the polarization resistance, that is to say the "resistance of the substrate to be protected against corrosion", which "resistance" is induced by the inhibiting composition, or again the efficiency of the inhibiting composition, increases proportionately with the total concentration of this composition in the corrosion medium, without any discontinuity appearing.

As in the preceding Example, a concentration of about 530 ppm gives again the best result.

(b) River water

The abovesaid composition was applied at the same successive concentrations of 50, 100, 260 and 530 ppm.

TABLE VI

| Concentration of the inhibiting composition in the corrosion medium | 50 ppm | 10 ppm | 260 ppm | 530 ppm |
|---|---|---|---|---|
| Rp (in Ω) | $4.7 \times 10^3$ | $3.4 \times 10^3$ | $2.9 \times 10^3$ | $3.1 \times 10^3$ |

It appears, on examining this table, that in fresh water, there is no notable discontinuity of the efficiency inspite of a slight exception of the polarization resistance at 265 ppm, which exception is apparently due to the inaccuracy of the measurement and, consequently, not significant.

A result common to the two experiments illustrated by Tables V and VI resides in the absence of discontinuity of the recorded values; this illustrates a notable advantage introduced by the use of the composition according to the invention. It is, in fact, known that the prior art compositions, of the $NaGl+ZnSO_4+HMPP$ type do no show this constancy from the point of view of efficiency.

EXAMPLE 6

In this Example, the influence of temperature on the efficiency of an inhibiting composition according to the invention was studied. The conditions were those of Examples 1, 2 and 3.

The composition applied comprises 50% of $ZnGl_2$ and 50% of HMPP.

The concentration of this composition in the corrosion medium was 530 ppm.

The results obtained are collected in Table VII.

TABLE VII

| T | Test temperature 20° C. | | | Test temperature 40° C. | | | Test temperature 60° C. | | | Test temperature 80° C. | | |
|---|---|---|---|---|---|---|---|---|---|---|---|---|
| in hours | I. | I | E | I. | I | E | I. | I | E | I. | I | E |
| 24 | | | | | | | 159 | | 100 | | | |
| 48 | | | | | | | 316 | | 100 | | | |
| 72 | 377,3 | 0 | 100 | 38,9 | 0 | 100 | 457,2 | | 100 | 259,1 | 26,7 | 89,7 |
| 144 | | | | | | | 861,8 | | 100 | | | |
| 168 | 656,7 | 9,7 | 98,5 | 213,8 | 10,5 | 95 | 999,5 | | 100 | 1 106 | 148,2 | 86,6 |
| 192 | | | | | | | 1 154,4 | | 100 | | | |
| 216 | | | | | | | 1 305,3 | | 100 | | | |
| 240 | 876,9 | 11,3 | 98,7 | 336,8 | 13,8 | 95,9 | 1 447 | | 100 | 1 676,9 | 689 | 58,9 |
| 312 | | | | | | | 1 936,6 | 8,9 | 99,5 | | | |
| 336 | 1 109,3 | 17,8 | 98,4 | 485 | 33,2 | 93,2 | 2 138,7 | 14,2 | 99,3 | 2 692,3 | 1 195,1 | 55,6 |
| 360 | | | | | | | | 15,0 | | | | |
| 384 | | | | | | | | 16,2 | | | | |
| 408 | 1 341,7 | 19,4 | 98,6 | 632,4 | 34,8 | 94,5 | 2 633,5 | 18,6 | 99,3 | 3 960,3 | 1 596 | 59,7 |
| 480 | | | | | | | 2 861,5 | 34,8 | 98,8 | | | |
| 504 | 1 628,3 | | | | | | 3 299,7 | 42,9 | 98,7 | | | |
| 528 | | 26,7 | 98,4 | | 48,6 | 93,4 | 3 421 | 58,3 | 98,3 | | 2 095,6 | 58,4 |
| 576 | 1 851,8 | 28,3 | 98,5 | 819,4 | 50,2 | 93,9 | 3 776,8 | 79 | 97,9 | 5 143,3 | 2 570,9 | 50 |
| 648 | | 55,9 | 97,2 | | 60,7 | 93,3 | 4 134,2 | 73,3 | 98,2 | | 3 377,3 | 42,2 |
| 672 | 2 086,6 | | | | | | 4 278 | 80,2 | 98,1 | | | |
| 696 | | | | | | | 4 459,4 | 108,1 | 97,6 | | | |
| 720 | | 108,5 | 95,2 | | 63,2 | 93,8 | 4 617,6 | 120 | 97,4 | | 4 093,9 | 35,2 |
| 744 | 2 295,6 | | | 1 030,8 | | | 4 754,9 | 128,8 | 97,3 | 6 300,4 | | |
| 816 | | 234 | 90,2 | | 64 | 94,4 | 5 002,4 | 160 | 96,8 | | 5 428,5 | 21,2 |
| 912 | 2 627,4 | | | 1 322,3 | | | | | | | | |
| 1 080 | | | | | | | | | | | | |
| 1 176 | | | | | | | | | | | | |
| 12 118 | | | | | | | | | | | | |

T = Time elapsed on each weighihg since the start of the experiment.

The results collected in this Table VII show that the temperature of the corrosion medium exerts a great influence on the effectiveness of the inhibiting compositions according to the invention.

This effectiveness increases for temperatures ranging from 20° to 60° C.; on the other hand, at the temperature of 80° C., the efficiency is very considerably lowered.

EXAMPLE 7

Comparison of various polyphosphates.

The performances obtained with the following compositions were compared:

Composition A:
- 50% Zinc gluconate
- 50% of HMPP

Composition C:
- 50% zinc gluconate
- 50% of TPP (tripolyphosphate)

Composition D:
- 50% of zinc gluconate
- 50% of PP (pyrophosphate)

The test conditions were the same as in Examples 1, 2,3 and 4, apart from the fact that the concentration in the test solution of inhibiting composition was each time 500 ppm in total.

The results obtained are collected in Table VIII below.

TABLE VIII

| | Test solution containing 500 ppm of inhibiting composition | | | | | |
|---|---|---|---|---|---|---|
| | $Gl_2Zn$ 50% HMPP 50% Composition A | | $Gl_2Zn$ 50% TPP 50% Composition C | | $Gl_2Zn$ 50% PP 50% Composition D | |
| T | I in mg/dm² | E in % | I in mg/dm² | E in % | I in mg/dm² | E in % |
| 96 | 17 | 97,2 | 7,29 | 98,79 | 122,27 | 79,78 |
| 168 | 30 | 97,2 | 39,68 | 96,03 | 344,94 | 65,49 |
| 264 | 35 | 97,9 | 52,63 | 96,84 | 744,13 | 55,26 |
| 336 | 49,5 | 97,7 | 56,68 | 97,35 | 1003,20 | 53,09 |
| 432 | 60,7 | 97,8 | 56,68 | 97,92 | 1314,98 | 51,68 |
| 504 | 63,0 | 98,9 | 56,68 | 98,25 | | |
| 600 | 64,8 | 98,3 | 68,85 | 98,18 | | |
| 672 | 72,1 | 98,3 | 77,25 | 98,33 | | |
| 768 | 72,1 | 98,5 | 87,45 | 98,19 | | |
| 840 | 86,6 | 98,4 | 114,17 | 97,84 | | |
| 936 | 96,4 | 98.4 | 153,04 | 97,40 | | |
| 1032 | | | 190,28 | 97,07 | | |
| 1104 | | | 182,18 | 97,38 | | |

After examining these results it is observed that, if the pyrophosphate gives results very much inferior to those obtained with HMPP, the excellent behavior of the tripolyphosphate is noted, although for 500 ppm total the preferred composition remains zinc glyconate—HMPP.

EXAMPLE 8

Study of the performances in river water of a composition according to the invention with 50% of $ZnGl_2$ and 50% of HMPP as a function of its concentration in the test solution, the temperature being 60° C.

The experimental conditions were those of Examples 1, 2, 3, apart from the fact that the test solution was constituted by river water (drinking water) and that the duration of the tests was limited to 500 hours.

The concentrations studied correspond respectively to 350, 450 and 530 ppm.

The results obtained were collected in Table IX below.

TABLE IX

| Control time hours | Control Io mg/dm² | Test time hours | $Gl_2Zn$ 50% HMPP 50% Concent. 350 ppm I mg/dm² | E in % | $Gl_2Zn$ 50% HMPP 50% Concent. 450 ppm I mg/dm² | E in % | Test time h | $Gl_2Zn$ 50% HMPP 50% I mg/dm² | 530 ppm E in % |
|---|---|---|---|---|---|---|---|---|---|
| 76 | 1126,32 | 96 | 38,06 | 96,62 | 74,49 | 93,39 | 76 | — | 100 |
| 168 | 1944,13 | 168 | 73,68 | 96,62 | 212,95 | 89,05 | 168 | — | 100 |
| 264 | 2634,82 | 264 | 176,52 | 93,30 | 598,38 | 77,29 | 240 | 5,61 | 99,83 |
| 336 | 4329,96 | 336 | 893,93 | 79,35 | 1369,23 | 68,38 | 336 | 32,79 | 99,24 |
| 408 | 5148,18 | | | | | | 408 | 123,48 | 97,60 |
| 504 | 6125,51 | 432 | 2770,85 | 48,29 | 2811,34 | 47,54 | 504 | 339,59 | 93,48 |

It appears from these results that a concentration of at least 400 ppm and preferably less than 1000 ppm of inhibiting composition according to the invention is the most advantageous.

In addition, although the efficiency of the composition diminishes proportionately with the concentration, it does not show any notable discontinuity.

We claim:

1. Composition for inhibiting corrosion by water of metal substrates comprising:

zinc gluconate or glucoheptonate and at least one water-soluble inorganic polyphosphate selected from the group consisting of alkali metal hexametaphosphate and tripolyphosphate, wherein the ratio by weight of zinc gluconate or glucoheptonate/polyphosphate is from 1/5 to 5/1.

2. Composition according to claim 1, wherein the ratio by weight of zinc gluconate or glucoheptonate/polyphosphate is from ¼ to 4/1.

3. Composition according to claim 1, wherein the ratio by weight of zinc gluconate or glucoheptonate/polyphosphate is from ⅓ to 3/1.

4. Composition according to claim 1, comprising zinc gluconate or glucoheptonate and sodium hexametaphosphate in a ratio by weight ranging from 1/5 to 5/1.

5. Composition according to claim 1, comprising zinc gluconate or glucoheptonate and sodium hexametaphosphate in a ratio by weight ranging from ¼ to 4/1.

6. Composition according to claim 1, comprising zinc gluconate or glucoheptonate and sodium hexametaphosphate in a ratio by weight ranging from ⅓ to 3/1.

7. Composition according to claim 1, comprising zinc gluconate or glucoheptonate and sodium hexametaphosphate in a ratio by weight ranging from 1/1 to 3/1.

8. Composition according to claim 1 in the form of a solid state mixture of the constituents.

9. Composition according to claim 1 in the form of an aqueous solution of the constituents.

10. Composition according to claim 1, comprising zinc gluconate and sodium hexametaphosphate in a ratio by weight ranging from 1/1 to 3/1.

11. Method of inhibiting corrosion by water of metal substrates, comprising adding to the water whose corrosive properties are to be inhibited, a composition comprising:

zinc gluconate or glucoheptonate and at least one water-soluble inorganic polyphosphate selected from the group consisting of hexametaphosphate and tripolyphosphate, wherein the ratio by weight of zinc gluconate or glucoheptonate/polyphosphate is from 1/5 to 5/1, the concentration in the water of the total amount of said composition ranging from about 50 to about 600 ppm.

12. Method according to claim 10, wherein the ratio by weight of zinc gluconate or glucoheptonate/polyphosphate is from ¼ to 4/1.

13. Method according to claim 10, wherein the ratio by weight of zinc gluconate or glucoheptonate/polyphosphate is from ⅓ to 3/1.

14. Method according to claim 10, wherein the ratio by weight of zinc gluconate or glucoheptonate/polyphosphate is from 1/1 to 3/1.

15. Method according to claim 10, wherein the concentration in the water of the total amount of the said composition ranges from 400 to 600 ppm.

16. Method according to claim 10, wherein the ratio by weight of zinc gluconate or glucoheptonate/polyphosphate is from ¼ to 4/1 and wherein the concentration in the water of the total amount of the said composition ranges from 400 to 600 ppm.

17. Method according to claim 10, wherein the ratio by weight of zinc gluconate or glucoheptonate/polyphosphate is from ⅓ to 3/1 and wherein the concentration in the water of the total amount of the said composition ranges from 400 to 600 ppm.

18. Method according to claim 10, wherein the ratio by weight of zinc gluconate or glucoheptonate/polyphosphate is from 1/1 to 3/1 and wherein the concentration in the water of the total amount of the said composition ranges from 400 to 600 ppm.

19. Method according to claim 18 wherein said composition comprises zinc gluconate and sodium hexametaphosphate.

* * * * *